US008113215B2

(12) United States Patent
Rasouli et al.

(10) Patent No.: US 8,113,215 B2
(45) Date of Patent: Feb. 14, 2012

(54) SMOKING ARTICLE FILTER HAVING LIQUID ADDITIVE CONTAINING TUBES THEREIN

(75) Inventors: Firooz Rasouli, Midlothian, VA (US); Andrey Bagreev, Chesterfield, VA (US); Weijun Zhang, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 410 days.

(21) Appl. No.: 12/213,553

(22) Filed: Jun. 20, 2008

(65) Prior Publication Data

US 2009/0007925 A1 Jan. 8, 2009

Related U.S. Application Data

(60) Provisional application No. 60/929,319, filed on Jun. 21, 2007.

(51) Int. Cl.
*A24D 3/06* (2006.01)

(52) U.S. Cl. ..... 131/337; 131/275; 131/335; 131/341

(58) Field of Classification Search ..... 131/335, 131/337

See application file for complete search history.

(56) References Cited

U.S. PATENT DOCUMENTS

| | | | |
|---|---|---|---|
| 2,999,296 | A | 9/1961 | Breen et al. |
| 3,066,681 | A | 12/1962 | Cohn |
| 3,228,877 | A | 1/1966 | Mahon |
| 3,528,553 | A | 9/1970 | Caracciolo |
| 3,530,861 | A | 9/1970 | Carty |
| 3,580,259 | A | 5/1971 | Luttich |
| 3,625,224 | A | 12/1971 | Leffingwell |
| 3,708,071 | A | 1/1973 | Crowley |
| 3,722,516 | A | 3/1973 | Suwa et al. |
| 3,750,674 | A | 8/1973 | Miller |
| 3,879,425 | A | 4/1975 | Hall et al. |
| 3,881,025 | A | 4/1975 | Flament |
| 3,884,247 | A | 5/1975 | Dietrich et al. |
| 3,890,981 | A | 6/1975 | Vinals et al. |
| 3,903,900 | A | 9/1975 | Wolt et al. |
| 3,914,451 | A | 10/1975 | Schreiber et al. |
| 3,915,175 | A | 10/1975 | Dietrich |
| 3,920,027 | A | 11/1975 | Demole |

(Continued)

FOREIGN PATENT DOCUMENTS

CA 2022967 2/1991

(Continued)

OTHER PUBLICATIONS

International Preliminary Report on Patentability issued Dec. 22, 2009 for PCT/IB2008/002579.

(Continued)

*Primary Examiner* — Richard Crispino
*Assistant Examiner* — Michael J Felton
(74) *Attorney, Agent, or Firm* — Buchanan Ingersoll & Rooney PC

(57) ABSTRACT

Provided are filters including at least one impervious additive containing tube. A barrier, such as a liquid barrier, seals each end of the tube so as to contain additives, such as a liquid additive, within the additive containing tube. The one or more additive containing tubes are inserted into filters for smoking articles. Drawing action during a puff causes breach of the barrier and release of the additive into the surrounding filter material.

22 Claims, 4 Drawing Sheets

U.S. PATENT DOCUMENTS

| | | | |
|---|---|---|---|
| 3,924,644 | A | 12/1975 | Anderson et al. |
| 3,966,989 | A | 6/1976 | Pittet et al. |
| 3,991,773 | A | 11/1976 | Walker |
| 4,234,431 | A | 11/1980 | Mishiro et al. |
| 4,281,671 | A | 8/1981 | Bynre et al. |
| 4,318,417 | A | 3/1982 | Hiroshi et al. |
| 4,340,481 | A | 7/1982 | Mishiro et al. |
| 4,729,391 | A | 3/1988 | Woods et al. |
| 4,744,932 | A | 5/1988 | Browne |
| 4,754,766 | A | 7/1988 | Luke et al. |
| 4,776,354 | A | 10/1988 | Norman et al. |
| 4,809,717 | A | 3/1989 | Imbery et al. |
| 4,821,750 | A | 4/1989 | Browne |
| 4,915,839 | A | 4/1990 | Marinaccio et al. |
| 4,941,484 | A | 7/1990 | Clapp et al. |
| 4,961,415 | A | 10/1990 | Radwanski et al. |
| 4,966,171 | A | 10/1990 | Serrano et al. |
| 4,971,078 | A | 11/1990 | Deutsch et al. |
| 4,981,522 | A | 1/1991 | Nichols et al. |
| 4,991,606 | A | 2/1991 | Serrano et al. |
| 5,019,122 | A | 5/1991 | Clearman et al. |
| 5,105,834 | A | 4/1992 | Saintsing et al. |
| 5,121,757 | A | 6/1992 | White et al. |
| 5,137,034 | A | 8/1992 | Perfetti et al. |
| 5,203,355 | A | 4/1993 | Clearman et al. |
| 5,246,017 | A | 9/1993 | Saintsing et al. |
| 5,275,859 | A | 1/1994 | Phillips et al. |
| 5,345,951 | A | 9/1994 | Serrano et al. |
| 5,356,704 | A | 10/1994 | Phillips et al. |
| 5,369,723 | A | 11/1994 | Counts et al. |
| 5,388,594 | A | 2/1995 | Counts et al. |
| 5,404,890 | A | 4/1995 | Gentry et al. |
| 5,435,326 | A | 7/1995 | Gentry et al. |
| 5,480,553 | A | 1/1996 | Yamamori et al. |
| 5,499,636 | A | 3/1996 | Baggett, Jr. et al. |
| 5,509,430 | A | 4/1996 | Berger |
| 5,666,976 | A | 9/1997 | Adams et al. |
| 5,692,525 | A | 12/1997 | Counts et al. |
| 5,692,526 | A | 12/1997 | Adams et al. |
| 5,810,020 | A | 9/1998 | Northway et al. |
| 5,845,649 | A | 12/1998 | Saito et al. |
| 5,856,006 | A | 1/1999 | Asai et al. |
| 5,915,387 | A | 6/1999 | Baggett, Jr. et al. |
| 5,951,744 | A | 9/1999 | Rohrbach et al. |
| 5,988,176 | A | 11/1999 | Baggett, Jr. et al. |
| 6,004,516 | A | 12/1999 | Rasouli et al. |
| 6,026,820 | A | 2/2000 | Baggett, Jr. et al. |
| 6,062,228 | A | 5/2000 | Loercks et al. |
| 6,174,603 | B1 | 1/2001 | Berger |
| 6,209,547 | B1 | 4/2001 | Koller et al. |
| 6,224,765 | B1 | 5/2001 | Watanabe et al. |
| 6,224,768 | B1 | 5/2001 | Navarre et al. |
| 6,440,223 | B1 | 8/2002 | Dube et al. |
| 6,584,979 | B2 | 7/2003 | Xue et al. |
| 6,595,218 | B1 | 7/2003 | Koller et al. |
| 6,623,637 | B1 | 9/2003 | Monzen et al. |
| 6,663,745 | B1 | 12/2003 | Cheng et al. |
| 6,685,832 | B2 | 2/2004 | Mahendran et al. |
| 6,702,561 | B2 | 3/2004 | Stillig et al. |
| 6,772,768 | B2 | 8/2004 | Xue et al. |
| 2002/0062833 | A1 | 5/2002 | Xue et al. |
| 2003/0224918 | A1 | 12/2003 | Lanier, Jr. et al. |
| 2004/0074507 | A1* | 4/2004 | MacAdam et al. ..... 131/337 |
| 2004/0261807 | A1 | 12/2004 | Dube et al. |
| 2006/0130861 | A1 | 6/2006 | Luan et al. |
| 2006/0174901 | A1 | 8/2006 | Karles et al. |
| 2006/0272662 | A1 | 12/2006 | Jupe et al. |
| 2006/0272663 | A1 | 12/2006 | Dube et al. |
| 2007/0074733 | A1 | 4/2007 | Rasouli et al. |

FOREIGN PATENT DOCUMENTS

| | | | |
|---|---|---|---|
| CH | 661412 | A5 | 7/1987 |
| CN | 1142339 | | 2/1997 |
| DE | 1903934 | | 11/1964 |
| EP | 0204512 | A | 12/1986 |
| EP | 0276021 | A2 | 7/1988 |
| EP | 0414437 | A2 | 2/1991 |
| EP | 0466114 | B1 | 9/1995 |
| EP | 1754419 | A1 | 2/2007 |
| GB | 2119221 | A | 11/1983 |
| JP | 6-30753 | | 2/1994 |
| JP | 6-62823 | | 3/1994 |
| WO | WO 92/05713 | A1 | 4/1992 |
| WO | WO 01/30183 | A1 | 5/2001 |
| WO | WO 01/70053 | A1 | 9/2001 |
| WO | WO 01/80671 | A1 | 11/2001 |
| WO | WO 2006/082525 | A1 | 8/2006 |
| WO | WO 2008/081338 | A2 | 7/2008 |

OTHER PUBLICATIONS

International Search Report and Written Opinion mailed Feb. 25, 2009 for PCT/IB2008/002579.

International Preliminary Report on Patentability dated Apr. 17, 2008 for PCT/IB2006/003884.

Partial International Search Report dated Jun. 28, 2007 for PCT/IB2006/003884.

International Search Report and Written Opinion dated Sep. 7, 2007 for PCT/IB2006/003884.

* cited by examiner

SMOKING ARTICLE FILTER HAVING LIQUID ADDITIVE CONTAINING TUBES THEREIN

CROSS REFERENCE TO RELATED APPLICATION

This application claims priority under 35 U.S.C. §119(e) to U.S. provisional Application No. 60/929,319, filed on Jun. 21, 2007, the entire content of which is incorporated herein by reference.

SUMMARY

Smoking articles are provided that include filters having at least one liquid additive containing tube therein. Preferably, the additive containing tubes hold additives that are contained therein by a barrier. In a preferred embodiment, the barrier includes at least one liquid layer that disperses when a puff of a smoking article is taken to release the enclosed additive.

DETAILED DESCRIPTION

As used herein, the "upstream" and "downstream" relative positions between filter segments and other features are described in relation to the direction of mainstream smoke as it is drawn from the tobacco rod and through the multi-component filter.

Figure 1:
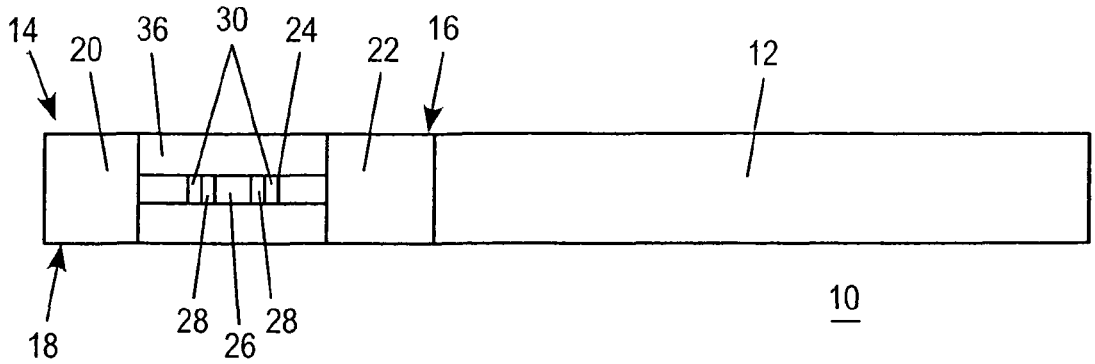
FIG. 1 is an illustration of a smoking article including a filter containing an additive containing tube.

Referring now to FIG. 1, in a preferred embodiment, a smoking article 10 includes a tobacco rod 12 and a filter 14. Preferably, the filter 14 includes at least one impervious, additive containing tube 24 located between a mouth end filter segment 20 and an upstream filter segment 22. Preferably, the additive containing tube 24 is disposed in a filter material 36. Preferably, the filter material 36 comprises a hollow acetate tube, a plug of cellulose acetate tow, a plug of carbon on cellulose acetate tow, filter paper, a body of porous adsorbent, and/or an impervious solid.

In a preferred embodiment, the impervious tube 24 contains at least one liquid additive 26. In a preferred embodiment, the additive 26 is a flavorant, such as a liquid flavorant. Preferably, the additive 26 is held in the tube 24 by at least one barrier layer 28. Also preferably, the additive 26 is held in the tube 24 by at least one barrier layer 28 at each end of the tube

24. Preferably, the at least one barrier layer is a liquid barrier layer. Also preferably, liquid barrier layers are placed away from the ends of the tube to prevent removal of the liquid barrier by contact with other materials via capillary action, wetting, and/or other phenomena during filter making and cigarette making operations.

A second barrier 30 may also be included. In an embodiment, the second barrier layer 30 comprises wax, films, gels, and/or emulsions. When a puff is drawn upon the filter 14, the barriers 28, 30 are caused to scatter, break and/or contract and the enclosed additive 26 is dispersed into the filter material, making the additive readily available upon its release from the tube 24 and during subsequent puffs. In an embodiment, the film and gel barrier layers are chosen to have an acceptable fluidity, such that when a puff is taken, the film or gel breaks and the additive is dispersed into the mouthend filter segment 20.

Figure 2:
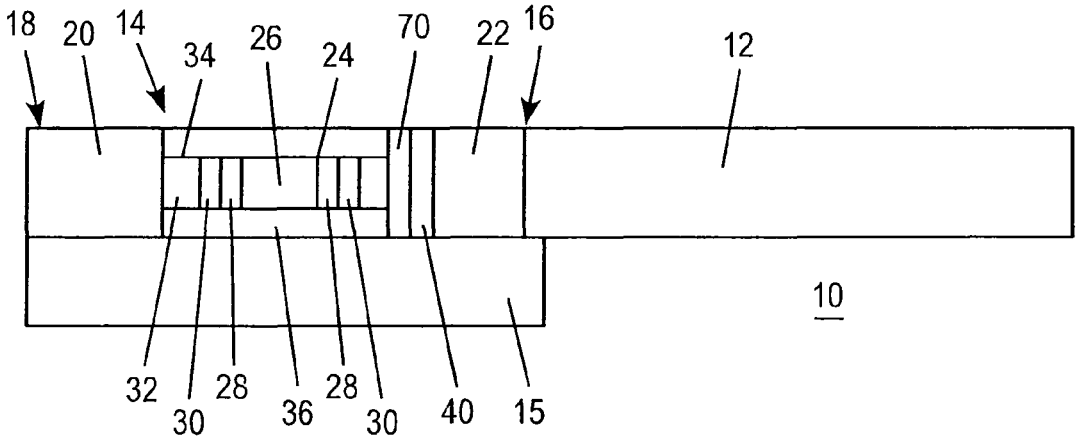
FIG. 2 is an illustration of a smoking article including a filter containing an additive containing tube and a sorbent.

In a preferred embodiment, as seen in FIG. 2, the additive containing tubes 24 are used in smoking articles 10, along with optional sorbents 40. The sorbent, such as microporous materials, can be used to filter or remove gas phase constituents from cigarette smoke. Sorbents (i.e., microporous sorbents) such as an activated carbon, silicas, zeolites and the like can be used.

While any suitable material can be used as a sorbent, a preferred sorbent includes activated carbon. However, sorbents present challenges to a cigarette designer's ability to add materials, such as volatile flavor components like menthol, as the sorbents may adsorb and/or absorb migrating volatile compounds during the time between cigarette manufacture and use.

Two problems occur when additive materials, such as volatile flavor components, are included in smoking articles with sorbents: first, the additive materials can migrate (dissipate) throughout the smoking article during storage; and second, the additive materials can be adsorbed or absorbed by the sorbents during smoking.

When additive materials are adsorbed and/or absorbed by sorbents, not only can additive materials be lost, but also the additive materials can occupy active sites in the sorbent. If the additive materials occupy active sites in the sorbent, the ability of the sorbent to remove targeted gases or constituents from smoke can be compromised. Additive containing tubes 24 can be used to overcome this problem by containing and isolating the additive materials 26 from the sorbent 40 prior to smoking, therefore avoiding interaction between the additive materials 26 and the sorbent 40 during storage (shelf-life).

In a preferred embodiment, a molecular sieve material can also be present in the filter 14. Preferably, the molecular sieve material can be present in monolithic or cavity filled particle form sized at about 0.1 mm to 1 mm, and more preferably 0.3 mm to about 0.9 mm (e.g., 0.3 mm to 0.4 mm, 0.4 mm to 0.5 mm, 0.5 mm to 0.6 mm, 0.7 mm to 0.8 mm or 0.8 mm to 0.9 mm) to facilitate processing into cigarette filters so as to achieve a desirable filter pressure drop or RTD (resistance to draw).

Various filter constructions known in the art can be used, in which additive containing tubes 24 can be incorporated. Exemplary filter structures that can be used include, but are not limited to, a mono filter, a dual filter, a triple filter, a single or multi cavity filter, a recessed filter, a free-flow filter, combinations thereof and the like. Filter elements are typically constructed from cellulose acetate tow or cellulose paper materials.

Referring now to FIG. 2, in an embodiment, the smoking article includes a tobacco rod 12 and a filter 14 joined together by tipping paper 15. Preferably, the filter 14 includes at least one impervious additive containing tube 24 and a sorbent 40. Preferably, the sorbent 40 is located upstream of the additive containing tube 24. As sorbents can adsorb or absorb additives such as a flavorant, placing the sorbent 40 upstream from the flavorant in the additive containing tubes 24 can reduce the level of absorption or adsorption of the flavorant by the sorbent 40 during smoking.

Preferably, the additive containing tubes 24 can be located in a portion of the filter 14 downstream from the sorbent 40 with a section of filter material 70, such as cellulose acetate, therebetween. Preferably, the additive containing tubes 24 and the sorbent 40, if provided, would be placed in cavities within a filter 14. However, both the additive containing tubes 24 and the sorbent 40, if provided, can be placed elsewhere within a filter 14 of a smoking article 10.

Regardless of the type of smoking article in which the additive containing tubes 24 is incorporated, the additive containing tubes 24 can be used to provide effective containment and delivery of materials, such as volatile flavors or other smoking related additives.

Figure 3:
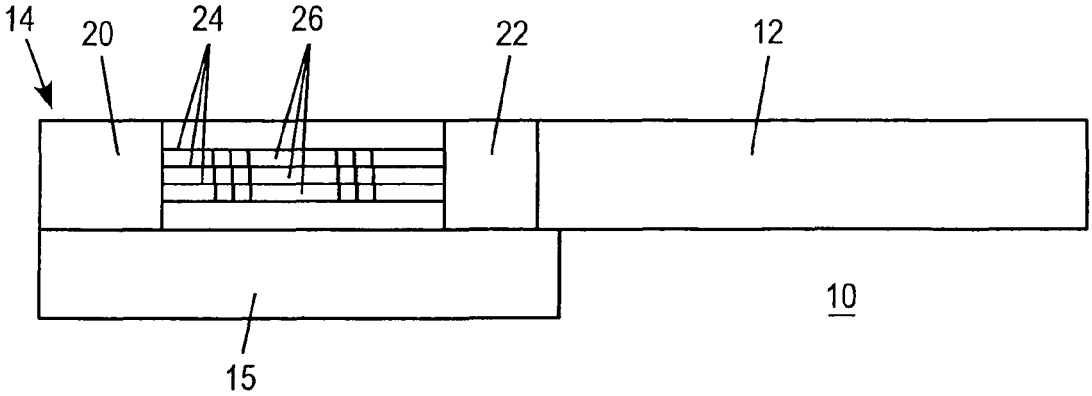
FIG. 3 is an illustration of a smoking article including a filter containing multiple additive containing tubes.

Referring now to FIG. 3, in a preferred embodiment, a smoking article 10 can include multiple additive containing tubes 24, each containing the same or different additive 26. Most preferably, a filter 14 contains 1 to about 5 tubes 24. More preferably, the filter 14 contains 1 to about 3 tubes 24.

Figure 4:
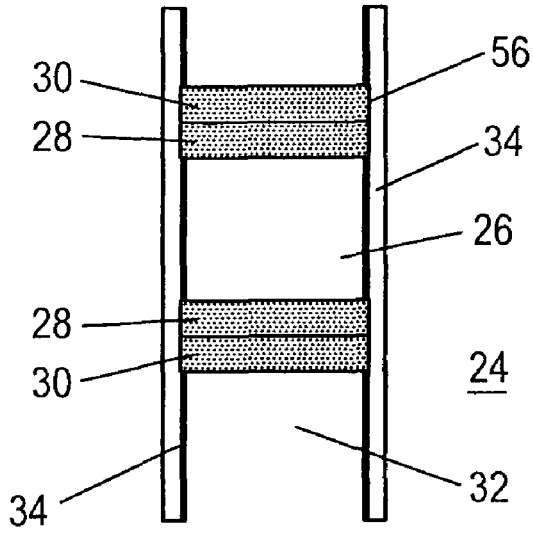
FIG. 4 is an illustration of an additive containing tube of a preferred embodiment.

Referring now to FIG. 4, in a preferred embodiment, the additive containing tubes 24 are preferably impervious tubes having lumens 32 capable of containing an additive 26. Preferably, the additive 26 is maintained within the impervious tube 24 by a first barrier layer 28 and optionally a second barrier layer 30. If desired, additional barrier layers can be included. Preferably, the first barrier layer 28 and the second barrier layer 30 are located upstream and downstream of the additive 26 within the tube 24.

Preferred additive containing tubes 24 are made of glass, polymers, cellulose base, and/or metal, such as, but not limited to polyethylene terephthalate, polysulfone, polyimide, Teflon, polytetrafluoroethylene (PTFE), fluorinated ethylene-propylene (FEP), polyetheretherketone (PEEK), silicon elastomer, and/or glass. Most preferably, the additive containing tubes 24 are glass. However, due to the fragility of glass, other materials, with or without additional coating to make the material more mechanically robust and/or impervious, are also suitable.

The impermeable additive containing tube can include a permeable tube wall 34 having a coating 56 to prevent loss of the additive 26 through the tube walls 34. For example, permeable polymer tubes may include a coating 56 of wax that is applied by heating the wax, applying the wax to the walls 34 of the tube 24, and then cooling the coated tube 24. Paraffin, silicon rubber and/or epoxy can also be used as a coating material. Glass tubes 24 typically do not require a coating 56 since glass is impervious. Preferably, the coating is about 0.01 mm to about 1.0 mm thick.

In a preferred embodiment, the tubes 24 have a lumen diameter of about 0.5 mm to about 2.5 mm, more preferably about 0.8 mm to 1.4 mm and most preferably about 0.9 mm to about 1.2 mm. If the diameter is too small liquid flavorant or any other liquid additive may not be withdrawable from the tubes 24 by drawing action during a puff. However, if the diameter is too large, the additive may not be retained in the tube because the capillary forces needed to hold both the additive and the liquid barrier in place may be insufficient. In accordance with a preferred embodiment, it is desirable to create a balance between delivery via puffing and the ability to retain an additive in a tube. Thus, the inner diameters of the additive containing tubes are preferably sized to optimize the additive containing tubes' ability to releaseably contain additive materials.

The liquid additive 26 is held within the tube 24 by capillary action and/or surface interaction, and preferably the liquid is releaseably maintained in the tubes by at least one barrier layer. Preferably, the additive containing tube 24 includes a first barrier layer 28 and a second barrier layer 30. Also preferably, the first barrier layer 28 is immiscible with the additive 26 and has a low solubility for the additive. As a result, the barrier layer prevents the additive from dissolving in the barrier layer and diffusing out of the additive containing tube 24. The second barrier layer 30 is added to prevent the release of the additive and loss of the first barrier layer. Preferably, the second barrier layer is chosen to have a low vapor pressure. Depending on the additive, additional barrier layers may be used. Preferably, each barrier layer is about 0.5 mm to about 2 mm thick.

EXAMPLE 1

Five micro-liters (5 μl) of 25% menthol in vegetable oil is injected into a 0.8 mm to 1 mm glass tube that is about 15 mm long. Then, about 1 mm to about 2 mm or water is injected at both ends of the tube to sandwich the flavor liquid and form a barrier. About 1 mm to about 2 mm of vegetable oil with 50% hydrogenated oil is injected at each end to form a second barrier layer.

EXAMPLE 2

5 μl of 25% menthol in vegetable oil is injected into a 0.8 mm to 1 mm inner diameter glass tube that is about 15 mm long. Then, a layer of about 1 mm to about 2 mm or water is injected at both ends of the tube to sandwich the flavor liquid and form a barrier. A layer of about 1 mm to about 2 mm of 3% wax in vegetable oil is injected at each end to form a second barrier layer.

Preferably, the following formula approximates the thickness of each liquid barrier layer based on the surface tension of the additive and the inside diameter of the tube:

$$h=2\tau \cos \theta/\rho r g$$

where $\tau$ is the surface tension of the liquid additive, $\rho$ is the density of the liquid additive, $\theta$ is the inner radius of the tube, $\theta$ of the angle between the surface and the liquid additive (contact angle), g is the gravitational acceleration and h is the height of the fluid rise in the tube.

In a preferred smoking article, additive containing tubes 24 are oriented in a direction in which smoke will travel through the smoking article 10. By providing such alignment, when a puff is taken, the barrier is displaced due to draw pressure to release the additive from the additive containing tube 24 and smoke can travel through lumens 32 of the additive containing tubes 24 in a direction approximately parallel to the suction or vacuum force applied at the downstream end of the smoking article drawing smoke from the upstream or lit end.

Additionally, when incorporating multiple additive containing tubes 24, the tubes 24 are preferably approximately parallel to the one another in order to allow smoke to evenly pass through the lumens 32 of the tubes 24, and for fitting bundles of tubes 24 into the axis of a filter for a smoking article when multiple additive containing tubes 24 are desired.

The additive containing tubes 24 can be used within any smoking article, such as a cigar and a traditional or less-traditional cigarette, e.g., in a cigarette filter. Less-traditional cigarettes include, by way of example, cigarettes for use with electrical smoking systems as described in commonly-assigned U.S. Pat. Nos. 6,026,820; 5,988,176; 5,915,387; 5,692,526; 5,692,525; 5,666,976; 5,345,951; 4,991,606; 4,966,171 and 5,499,636, the disclosures of which are hereby incorporated by reference herein in their entireties.

Additive containing tubes 24 are preferably sized to a length less than the length of a filter 14 so that the entire length of the tube can fit within the area of the filter 14 as the additive containing tubes 24 are aligned in the direction of smoke flow. Also, the diameters of the lumens 32 (space within the tube) of the additive containing tubes 24 (in combination with the material used to make the additive containing tubes and the density of any bundle of additive containing tubes) control the amount of flow possible, as well as the force required to pull the tobacco smoke through the filter (hereinafter, resistance to draw (RTD)). The smoke can travel through the lumens 32 and/or around the exterior of the tubes 24.

Preferred embodiment additive containing tubes 24 are used to releasably hold additive materials within the lumens 32 of the additive containing tubes 24. Thus, because of the releasable hold, additive materials 26 in the additive containing tubes 24 can be sufficiently contained to substantially avoid or minimize unwanted migration of the additive materials, such as, for example, during shipping, storage and shelf-life at retail of the smoking articles with the additive materials therein.

Therefore, in a typically-sized cigarette (e.g., a cigarette with a length between 65-100 mm, a diameter of 6-9 mm and a filter length of 15-30 mm), the additive containing tubes can have a lumen (i.e., inner) diameter of approximately 0.5 millimeters (mm) to approximately 2.0 mm (e.g., 0.5-1.0, 1.0-1.5, 1.5 to 2.0 mm), preferably approximately 0.8 mm to approximately 1.4 mm, and most preferably approximately 0.9 mm to approximately 1.2 mm.

Figure 5:
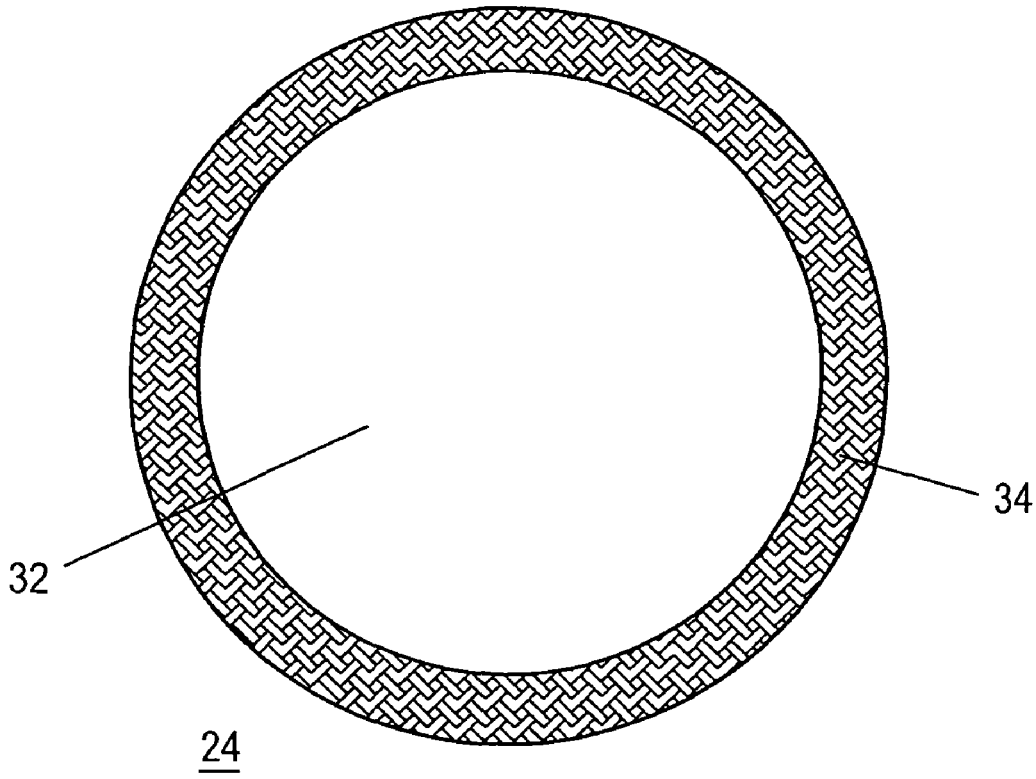
FIG. 5 is a cross-sectional view of the additive containing tube of FIG. 2.

FIG. 5 is a cross-sectional view of an additive containing tube 24 showing the lumen 32 and the outer wall 34 thereof.

In an exemplary embodiment, a filter for a cigarette can be designed to include a bundle of 1 to 5 additive containing tubes (e.g., 1 to 3, 2 to 4, 3 to 5 or 2 to 3). Preferably, each additive containing tube therein has a lumen diameter of approximately 0.9 mm to approximately 1.2 mm, a wall thickness of approximately 50 microns.

In order to use the additive containing tubes 24 in a smoking article, the additive containing tubes 24 are cut or otherwise made to a specific length. The additive containing tubes 24 can preferably be used in a circumferentially spaced relation in a filter section of a smoking article or can be gathered into a bundle prior to insertion into a final product. If the additive containing tubes are bundled, the additive containing tubes 24 can be held together using a permeable, semi-permeable or impermeable material, such as a potting material, an enclosure, such as a ring, or an adhesive, such as triacetin, epoxy, and silicone rubber.

Additive containing tubes 24 can also be incorporated into a cigarette filter to provide a means for controlling a resistance to draw (RTD) in a cigarette. In a preferred embodiment, a cigarette filter would include additive containing tubes 24 therein. By providing additive containing tubes in a cigarette, a cigarette can be provided with as little or as much resistance to draw as desired.

Additionally, additive containing tubes 24 can be used to supplement or replace multi-section filter assemblies, which are often more difficult to manufacture than additive containing tubes 24. Thus, additive containing tubes 24 in cigarette filters could be used to simplify the manufacturing process while still providing tailored levels of RTD.

Figure 6:
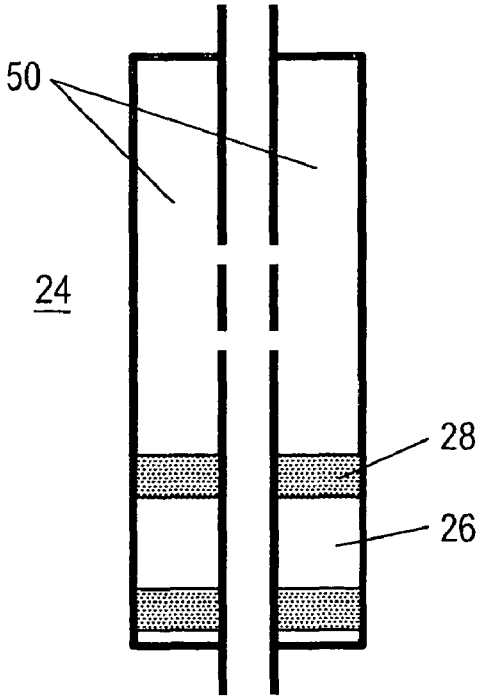
FIG. 6 is an illustration of an additive containing tube of a preferred embodiment.
Figure 7:
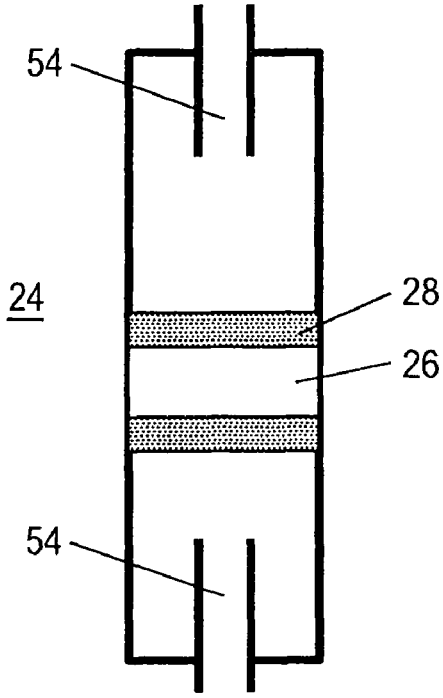
FIG. 7 is an illustration of an additive containing tube of a preferred embodiment.
Figure 8:
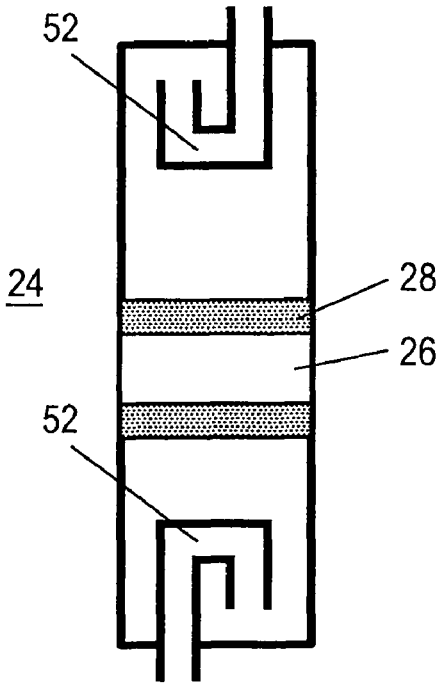
FIG. 8 is an illustration of an additive containing tube of a preferred embodiment.

Referring now to FIGS. 6, 7, and 8, in an embodiment, the tube 24 can be designed to improve the ability of the tube to contain the additive 26 under severe shaking or vibrations that may occur during shipment. While the barrier layer 28 can contain the additive 26 when stored, when shaken, the barrier 28 may disperse and release the additive 26. Thus, the tubes 24 may include multiple chambers 50, as seen in FIG. 6, and/or curved channels leading to orifices 52, as seen in FIG. 8, so as to help secure the additive within the tube. In an embodiment, as seen in FIG. 7, the tube 24 includes an elongated channel 54 leading to an orifice.

Additive containing tubes can desirably be used to contain additives in a smoking article. Preferably, the additives are protected from loss during shipment and storage so as to maintain freshness of the product.

The additive containing tubes 24 can preferably be placed in a smoking article 10, more preferably a cigarette filter 14, where the additive containing tubes 24 are aligned in a cigarette for airflow. For example, the long axes of the additive containing tubes 24 can be aligned with the long axis of the cigarette for airflow purposes.

The additives can be flavorants, which can be selected from any number of known artificial and natural materials, such as, for example, peppermint, spearmint, wintergreen, menthol, eugenol, cinnamon, chocolate, coffee, tobacco, vanillin, licorice, clove, anise, sandalwood, geranium, rose oil, vanilla, lemon oil, cassia, spearmint, fennel, ginger, ethylacetate, isoamylacetate, propylisobutyrate, isobutylbutyrate, ethylbutyrate, ethylvalerate, benzylformate, limonene, cymene, pinene, linalool, geraniol, citronellol, citral, peppermint oil, orange oil, coriander oil, borneol, fruit extract and the like. Illustrative of such tobacco flavorants are those described in U.S. Pat. Nos. 3,580,259; 3,625,224; 3,722,516; 3,750,674; 3,879,425; 3,881,025; 3,884,247; 3,890,981; 3,903,900; 3,914,451; 3,915,175; 3,920,027; 3,924,644; 3,966,989; 4,318,417; and the like, which are incorporated herein by reference in their entirety.

The additives can also be chemicals, such as chemicals used to attract or repel aerosols, chemicals that react with smoke constituents to remove or chemically extract smoke constituents, solvents, surfactants, anti freezing agents and/or stimuli responsive polymers or gels.

Figure 9:
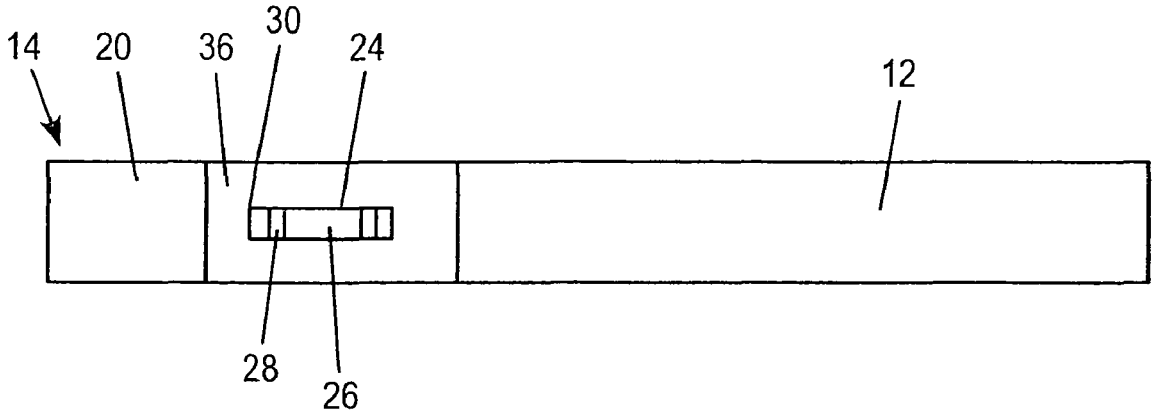
FIG. 9 is an illustration of a smoking article including a filter containing an additive containing tube.

In an embodiment, as shown in FIG. 9, the filter 14 can include a tube 24 located near the tobacco rod 12. The tube 24 can include a first barrier layer 28 and/or a second barrier layer 30. The barrier layers 28, 30 at an upstream end of the tube 24 can be formed of a heat sensitive material that melts or otherwise dissipates when heated, such that the additive is released when the barrier layer 28, is heated. The downstream layers 28, 30 can be liquid barriers, as described above. After the upstream barrier layer 28, 30 melts, the user takes a puff, which then causes both the downstream puff activated liquid barrier layers 28, 30, formed as described above, and the upstream heat activated barrier layers 28, 30 including the melted heat sensitive material to dissipate and the additive 26 to be released from the tube 24. In an embodiment, the first barrier layer 28 at the upstream end of the tube can be a liquid barrier layer and the second barrier layer 30 can be a heat sensitive barrier layer.

Preferably, the upstream end of the tube 24 lies within the filter 14 about 0.01 mm to about 3.0 mm away from the downstream end of the tobacco rod 12. Once the tobacco rod 12 has burned nearly to the filter 14, the barrier layer 28, formed of the heat sensitive material heats up and melts. Thus, when the cigarette has nearly completely burned, the additive 26 is released from the tube 24 having the barrier layer 28, 30 formed of the heat sensitive material. For example, the sealant at the upstream end of the tube can be a thermally responsive material which is solid or semi-solid at ambient temperature and free flowing at 50 to 80° C. The sealant at the downstream end of the tube can be a liquid. As the burning tobacco gets closer to the upstream end of the tube, heat from the burning tobacco causes the upstream sealant to become free flowing thereby allowing liquid flavorant in the tube to spread into surrounding filter material and release flavor into mainstream smoke during remaining puffs.

The heat sensitive material can be selected from the group consisting of wax, paraffin, glycerol, a mixture of polymers and combinations thereof. Preferably, the heat sensitive material melts when exposed to temperatures of about 60° C. to about 90° C. The polymers and other heat sensitive materials can be selected so that the melting point thereof falls within the preferred range.

In a preferred embodiment, the heat sensitive material is a mixture of beeswax in vegetable oil. Preferably, the mixture includes about 7% to about 20% beeswax in vegetable oil based on the volume of the mixture. Such mixtures are semi-solid or solid at ambient temperature and melt when exposed to heat. Mixtures including lower amounts of beeswax are in liquid form at ambient temperature and thus will not form a solid barrier 28, 30 that melts in response to heat provided by the burning tobacco rod 12.

Table 1 compares when the delivery of additive occurred during smoking from cigarette filters including 20 mm long, 1.45 mm internal diameter polyimide tubes 24 having an upstream barrier including 7% beeswax in vegetable oil, 15% beeswax in vegetable oil or 17% beeswax in vegetable oil. The cigarettes were puffed under FTC conditions.

TABLE 1

| Barrier Layer | Additive Delivered Before Last Puff | Additive Delivered At Last Puff | Additive Not Delivered |
|---|---|---|---|
| 7% beeswax in oil | 6 out of 8 samples | 2 out of 8 samples | none |
| 15% beeswax in oil | 0 out of 3 samples | 3 out of 3 samples | none |
| 17% beeswax in oil | 0 out of 4 samples | 1 out of 4 samples | 3 out of 4 samples |

As shown in Table 1, tubes including a barrier layer including 15% beeswax in oil more consistently released the additive at last puff as desired. In contrast, tubes including a barrier layer of 7% beeswax in oil were more likely to prematurely release the additive. Tubes including 17% beeswax in oil were more likely to fail to deliver the additive. Thus, in a most preferred embodiment, the barrier layer includes about 12% to about 16% beeswax in oil.

Figure 10:
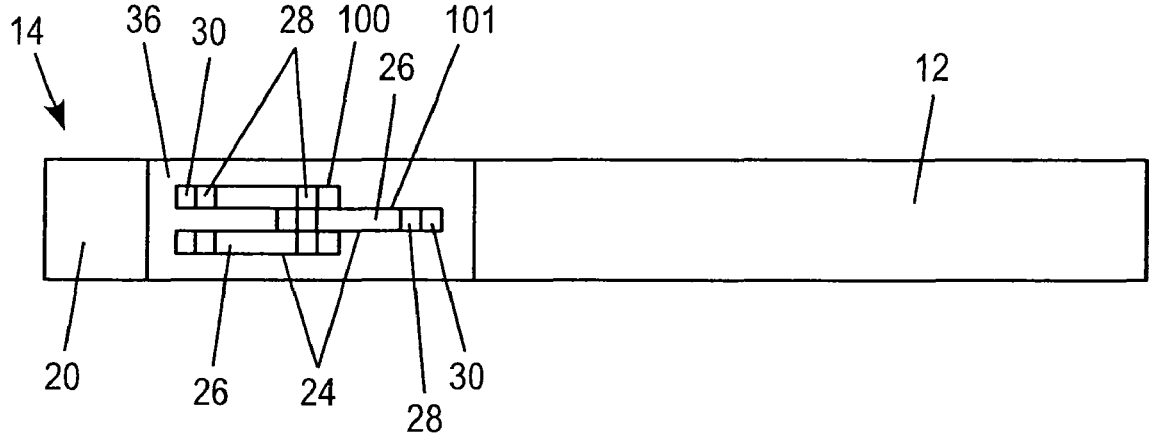
FIG. 10 is an illustration of a smoking article including a filter containing an additive containing tube.

In another embodiment, as shown in FIG. 10, the filter can include tubes 24 that are puff activated 100 and tubes that are heat activated 101. The tubes 24 can be in a staggered relationship such that the tubes 24 having an upstream heat sensitive barrier layer 28, 30 are located closer to the tobacco rod 12. The tubes 24 without heat sensitive barrier layers 28, 30 release the additive 26 from the tube 24 in response to drawing action during a puff on the cigarette. Additional additives 26 are later released from the tubes 24 having the heat sensitive barrier layers 28, 30 when the cigarette tobacco rod 12 has almost completely burned. Thus, the additives 26 can be delivered from the tube 24 at various times throughout the use of the cigarette.

In this specification, the word "about" is often used in connection with numerical values to indicate that mathematical precision of such values is not intended. Accordingly, it is intended that where "about" is used with a numerical value, a tolerance of 10% is contemplated for that numerical value.

While the invention has been described in detail with reference to specific embodiments thereof, it will be apparent to those skilled in the art that various changes and modifications can be made, and equivalents employed, without departing from the scope of the appended claims.

What is claimed is:

1. A smoking article filter comprising:

at least one impervious additive containing tube having a lumen therein, the lumen including at least one liquid additive material contained therein, a first barrier layer on each end thereof, and a second barrier layer located adjacent to each of the first barrier layers, and wherein the first and second barrier layers are contained within the lumen of the at least one impervious additive containing tube; and at least one plug of filter material.

2. The smoking article filter of claim 1, wherein said first barrier layer is a liquid barrier layer and said second barrier layer is a film barrier layer, a wax barrier layer, and/or a gel barrier layer.

3. The smoking article filter of claim 1, wherein said at least one plug of filter material is located upstream and/or downstream of said at least one impervious additive containing tube and wherein said filter material is carbon on tow and/or cellulose acetate.

4. The smoking article filter of claim 1, wherein said at least one impervious additive containing tube is centrally located in said filter and wherein said at least one impervious additive containing tube is at least partially surrounded by a filter material.

5. The smoking article filter of claim 4, wherein said filter material is a hollow cellulose acetate tube, carbon on tow, cellulose acetate, and/or an impervious solid.

6. The smoking article filter of claim 1, wherein said at least one additive containing tube is made of a material selected from the group consisting of polyethylene terephthalate, polysulfone, polyimide, polytetrafluoroethylene, fluorinated ethylene-propylene, polyetheretherketone, silicon elastomer, glass, and/or combinations thereof.

7. The smoking article filter of claim 1, wherein said liquid additive material comprises a flavorant, a reagent which chemically reacts with and selectively separates a gaseous component of a smoke stream, a surfactant, a solvent, an anti freezing agent, a stimuli responsive polymer or gel or combinations thereof.

8. The smoking article filter of claim 7, wherein the additive material comprises menthol.

9. The smoking article filter of claim 8, wherein the filter further comprises a sorbent located upstream of said at least one impervious additive containing tube.

10. The smoking article filter of claim 1, wherein said at least one impervious additive containing tube includes a coating so as to prevent said liquid additive from migrating through said tube, and wherein said coating is about 0.01 mm to about 1.0 mm thick.

11. The smoking article filter of claim 10, wherein said coating is a wax, paraffin, silicon rubber, and/or epoxy coating.

12. The smoking article filter of claim 1, wherein said at least one impervious additive containing tube has an inner diameter of about 0.5 mm to about 2.0 mm or about 0.8 mm to about 1.4 mm.

13. The smoking article filter of claim 1, wherein said filter includes about 1 to about 5 impervious additive containing tubes.

14. The smoking article filter of claim 1, wherein said first barrier layer is immiscible with and has a low solubility for said at least one liquid additive.

15. The smoking article filter of claim 1, wherein said at least one liquid additive is contained within said lumen by capillary action and/or surface interaction and wherein said at least one liquid additive is released into mainstream smoke during puffing.

16. The smoking article filter of claim 1, wherein said second barrier layer comprises a heat sensitive material and wherein the at least one liquid additive is released into mainstream smoke upon heating the second barrier layer.

17. A method of manufacturing a cigarette filter, comprising:

injecting a liquid additive into a lumen of an additive containing tube;

injecting a first barrier material into the lumen at each end of the additive containing tube and forming a first barrier layer within the lumen of the additive containing tube, and which surrounds the liquid additive;

injecting a second barrier material into the lumen at each end of the additive containing tube and forming a second barrier layer within the lumen of the additive containing tube, and which surrounds each of the first barrier layers;

surrounding said additive containing tube with filter material to form a filter segment; and incorporating the filter segment in a filter rod.

18. The method of claim 17, wherein said additive material comprises a flavorant, a reagent which chemically reacts with and selectively separates a gaseous component of mainstream tobacco smoke, a surfactant, a solvent or combinations thereof.

19. The method of claim 17, wherein said first barrier material is water, and said second barrier material is a film, a wax, and/or a gel.

20. A method of treating mainstream tobacco smoke with an additive comprising:

releaseably retaining the additive in a lumen at a location along a path defined by draw of mainstream smoke, including isolating said additive within said lumen with a releasable first barrier layer on each end thereof, and a releasable second barrier on each end of the releasable first barriers, and wherein the releasable first and second barrier layers are contained within said lumen; and during a puff, contacting said mainstream smoke with said additive by withdrawing said releaseably retained additive from said lumen with a drawing action of said puff.

21. The method of claim 20, further comprising displacing the releasable first and second barrier layers with the drawing action of said puff.

22. The method of claim 20, wherein said first barrier layers are a liquid barrier layer and said second barrier layers are a film barrier layer, a wax barrier layer, and/or a gel barrier layer.

* * * * *